US007836827B2

(12) United States Patent
Fu

(10) Patent No.: US 7,836,827 B2
(45) Date of Patent: Nov. 23, 2010

(54) METHOD OF OPERATING A SUPERCAVITATING PROJECTILE BASED ON TIME CONSTRAINTS

(75) Inventor: Jyun-Horng Fu, Centreville, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 155 days.

(21) Appl. No.: 12/327,571

(22) Filed: Dec. 3, 2008

(65) Prior Publication Data

US 2009/0173249 A1 Jul. 9, 2009

Related U.S. Application Data

(60) Provisional application No. 60/992,025, filed on Dec. 3, 2007.

(51) Int. Cl.
*F42B 19/00* (2006.01)

(52) U.S. Cl. ..... 102/399; 102/381; 114/20.1; 114/20.2

(58) Field of Classification Search ..... 102/399, 102/341, 374, 381, 390; 114/20.1, 20.2
See application file for complete search history.

(56) References Cited

U.S. PATENT DOCUMENTS

| | | | | |
|---|---|---|---|---|
| 3,149,600 | A | 9/1964 | Traksel | |
| 3,171,379 | A | 3/1965 | Schell, Jr. et al. | |
| 5,955,698 | A | 9/1999 | Harkins et al. | |
| 6,167,829 | B1 | 1/2001 | Lang | |
| H001938 | H | 2/2001 | Harkins et al. | |
| 6,405,653 | B1 | 6/2002 | Miskelly | |
| 6,439,148 | B1 | 8/2002 | Lang | |
| 6,601,517 | B1 | 8/2003 | Guirguis | |
| 6,684,801 | B1 | 2/2004 | Kuklinski | |
| 6,739,266 | B1 | 5/2004 | Castano et al. | |
| 7,123,544 | B1 | 10/2006 | Kuklinski | |
| 7,226,325 | B1 | 6/2007 | Kirschner et al. | |
| 7,347,146 | B1 * | 3/2008 | Gieseke | 102/399 |
| 2002/0106946 | A1 | 8/2002 | Simmons | |
| 2004/0231552 | A1 | 11/2004 | Mayersak | |
| 2007/0077044 | A1 | 4/2007 | Kirschner et al. | |
| 2009/0173248 | A1 * | 7/2009 | Fu | 102/399 |
| 2009/0173249 | A1 * | 7/2009 | Fu | 102/399 |

OTHER PUBLICATIONS

Wosnik et al., "Experimental Study of a Ventilated Supercavitating Vehicle", "Fifth International Symposium on Cavitation 2003 Osaka, Japan", Nov. 1-4, 2003.

Alyanak et al., "Optimum design of a supercavitating torpedo considering overall size, shape, and structural configuration", "http://www.sciencedirect.com Science Direct, International Journal of Solids and Structures", 2005, Publisher: Elsevier B.V.

Choi et al., "Stability analysis of supercavitating underwater vehicles with adaptive cavitator", "http://www.sciencedirect.com Science Direct, International Journal of Mechanical Sciences", 2006, Publisher: Elsevier Ltd.

* cited by examiner

*Primary Examiner*—Michael Carone
*Assistant Examiner*—Jonathan C Weber
(74) *Attorney, Agent, or Firm*—DeMont & Breyer, LLC

(57) ABSTRACT

A method for operating a thrust-generating supercavitating projectile involves launching the projectile in water from rest at the maximum available thrust, maintaining that thrust until supercavitating movement begins, and then reducing thrust to a near-minimum amount that is required to maintain supercavitating movement of the projectile.

4 Claims, 5 Drawing Sheets

METHOD OF OPERATING A SUPERCAVITATING PROJECTILE BASED ON TIME CONSTRAINTS

STATEMENT OF RELATED CASES

This case claims priority of U.S. Provisional Patent Application 60/992,025 filed Dec. 3, 2007, which is incorporated herein by reference.

FIELD OF THE INVENTION

The present invention relates to supercavitating projectiles.

BACKGROUND OF THE INVENTION

Cavitation is a general term used to describe the behavior of voids or bubbles in a liquid. Cavitation occurs when water pressure is lowered below its vapor pressure or vapor pressure is increased to water pressure. When this happens, the water vaporizes, typically forming small bubbles of water vapor. But these bubbles of water vapor are typically not sustainable. Rather, the bubbles collapse, and when they do, they force liquid energy to very small volumes. This results in localized high temperature and the generation of shock waves.

Cavitation is ordinarily an unintended and often undesirable phenomenon. The collapse of small bubbles produces great wear on pump components and can dramatically shorten the useful life of a propeller or pump. It also causes a great deal of noise, vibration, and a loss of efficiency.

But the phenomenon of cavitation is not always undesirable; an exception is the phenomenon of "supercavitation." In supercavitation, a sustainable bubble of gas inside a liquid is created by a "nose cavitator" of a moving object. This bubble envelopes the entire moving object except for the nose, with the result that the drag experienced by the moving object is significantly reduced. As a consequence, a supercavitating object can travel at far greater speeds for a given amount of thrust than an object that is moving in a conventional manner through water. Supercavitation enhances motion stability of an object as well.

A supercavitating (hereinafter also "cavity-running") object's main features are a specially shaped nose and a streamlined, hydrodynamic, and aerodynamic body. When the object is traveling through water at speeds in excess of about one hundred miles per hour, the specially-shaped nose deflects the water outward so fast that the water flow separates and detaches from the surface of the moving object. Since water pressure takes time to collapse the wall of the resulting cavity, the nose opens an extended bubble or cavity of water vapor. Given sufficient speed, the cavity can extend to envelop the entire body of the object. A cavity-running object quite literally 'flies' through the surrounding gas. In the absence of sustaining propulsion, the moving object loses supercavitation and eventually stalls due to drag.

SUMMARY OF THE INVENTION

The present invention provides improved designs for cavity-running projectiles and improved methods for their operation.

The present inventor has identified a variety of important operational considerations pertaining to cavity-running projectiles. These include, without limitation:

- An operational mode for expending the minimal thrust required to sustain supercavitation (hereinafter "threshold thrust").
- Optimization of projectile structural design as a function of parameters such as operating depth and available thrust.
- Defining operational limits for a cavity-running projectile as a function of available thrust and certain structural considerations of the projectile.
- Operating to achieve certain mission requirements, such as minimizing a projectile's time-of-arrival (or time-to-impact).
- Defining the best way accelerate a projectile from rest to supercavitation.

It is advantageous to reduce, to the extent possible, the amount of thrust that is required to sustain a projectile in a cavity-running mode of operation through water. The present inventor recognized that the threshold thrust would likely be related to certain structural aspects of the projectile, among any other parameters.

In fact, the present inventor found that there is a relationship between the threshold thrust and the ratio of the diameter $D_B$ of the body of the projectile to the diameter $D_N$ of the nose of the projectile. That is, to the extent that certain other parameters are fixed, there an "optimal" ratio of the aforementioned diameters, in the sense that it minimizes the threshold thrust. That optimal value of the ratio $D_B$:$D_N$ is about 4.1.

Using the same line of reasoning and related mathematical expressions, the present inventor also developed an expression for determining the maximum allowable projectile depth under water for sustaining a cavity-running mode for a given amount of thrust. And the present inventor also developed an expression for determining an "optimal" diameter of the projectile's nose given a certain amount of thrust and an operating depth. Optimal in a sense that, at the calculated the diameter, the thrust is the threshold thrust. These expressions can be employed to provide various operating scenarios for the projectile.

The present inventor further recognized that the most efficient way (in terms of minimizing thrust requirements) to operate a supercavitating projectile is to:

- launch it at some velocity above a minimum that is required to maintain supercavitating movement of the projectile;
- permit the velocity of the projectile to decrease to a value just above that required to sustain supercavitating movement; and
- initiate thrust to maintain supercavitating movement, wherein just enough thrust is applied to maintain supercavitating movement (i.e., the threshold thrust).

The present inventor also theorized that there might be a way to operate a supercavitating projectile that minimizes the projectile's time-to-impact at a target. In particular, consider a projectile that is launched from a ship into the water and is to attain a cavity running mode. Due to the high initial velocity of the projectile, the drag it experiences is relatively large. The drag abates as the projectile slows. If additional thrust (to maintain cavity running operation) is initiated too early, the projectile loses the benefit of some additional drag attenuation. If, on the other hand, additional thrust is delayed for too long, the projectile might lose supercavitation or suffer stability and control issues.

In fact, the present inventor determined that by appropriately delaying the time when thrust is initiated, the time-to-impact can indeed be minimized. The delay is given by the expression:

$$t_1=[1/(KV_c)]\times[\tan^{-1}(V_0/V_c)-\tan^{-1}(cV_{sc}/V_c)], \quad [1]$$

wherein:

$K=(\Pi/8m)\times\rho_{water}D_N^2C_{d0}$;

m is the mass of the projectile;

$\rho_{water}$ is the density of the water at the relevant temperature;

$D_N$ is the diameter of the projectile's nose;

$C_{d0}$ is the drag coefficient under supercavitation;

c is a parameter used for specifying thrust;

$V_c$ is the characteristic velocity: $V_c=(2P/\rho_{water})$;

P is the static drag $V_0$ is initial velocity.

The present inventor also recognized that an issue exists as to the manner in which a projectile is accelerated from rest to supercavitation. In fact, the inventor determined that the most efficient method of operation for a projectile accelerating from rest to supercavitation is to apply maximum thrust for a period of time and then reduce the thrust to the threshold thrust (i.e., the amount of thrust required to maintain supercavitation). The time to switch from maximum thrust to threshold thrust is given by the expression:

$$t^*=(\tfrac{1}{2}K_b)\times \mathrm{In}[(1+(2-\epsilon)^{0.5})/(1-\epsilon^{0.5})], \quad [2]$$

wherein:

$K_b=(\Pi/8m)\times\rho_{water}D_B^2C_{d0}$;

m is the mass of the projectile;

$\rho_{water}$ is the density of the water at the relevant temperature;

$D_B$ is the diameter of the projectile's body;

$C_{d0}$ is the drag coefficient under supercavitation;

$\epsilon=E/E_{s,\,max}$ $E=E_c\equiv\tfrac{1}{2}V^2$ $E_{s,\,max}=(B_{max}/2K_b)-E_c$ V is projectile velocity; and $B_{max}$ is the maximum available thrust.

DETAILED DESCRIPTION

Figure 1:
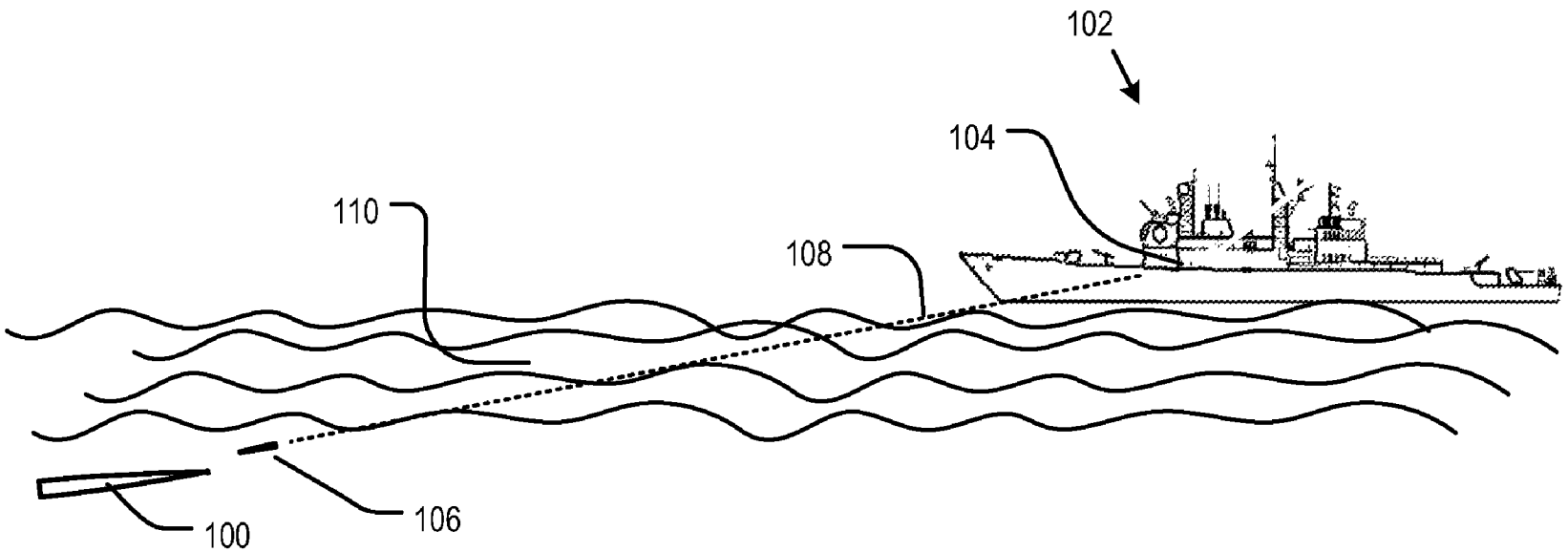
FIG. 1 depicts a projectile being fired into the water from the deck of ship, wherein the projectile enters a cavity-running mode under water, as described in co-pending patent applications by applicant.

FIG. 1 depicts a known weapons system comprising a deck-launched anti-torpedo projectile 106. The system includes both LIDAR and SONAR (not depicted) for target acquisition and an integrated weapons control system 104. Projectile 106 is launched from ship 102 and follows trajectory 108 into water 110 at a shallow grazing angle to intercept torpedo 100.

Projectile 106 must be capable of (1) flying through the air, (2) maintaining integrity as it penetrates the surface of the water, (3) maintaining trajectory (avoid pitch down, skipping, etc.) as it enters the water, and (4) moving through water in a cavity-running mode. Such a projectile should possess the following characteristics:

- is fin or spin stabilized (for requirement 1);
- is constructed of suitably strong materials of appropriate diameter (for requirement 2);
- a stepped profile characterized by a plurality of substantially right-circular cylindrical sections of increasing diameter or a stepped profile defined by a plurality of substantially right-circular conic sections of increasing diameter (for requirement 3);
- a forward center of gravity (for requirements 3 and 4);
- a blunt nose (for requirements 3 and 4);
- suitable dimensions (e.g., ratio of nose diameter to body diameter, etc.) (for requirement 4); and
- tail fins with a relatively smaller span and a relatively longer chord (for requirement 4).

A projectile suitable for this service has been described in applicant's co-pending patent application Ser. No. 12/057,123, which is incorporated by reference herein.

Figure 2:
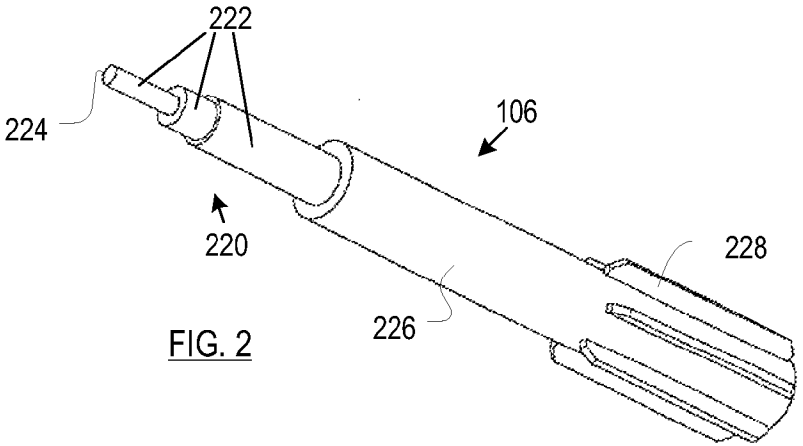
FIG. 2 depicts a supercavitating projectile, as described in co-pending patent applications by applicant.
Figure 3:
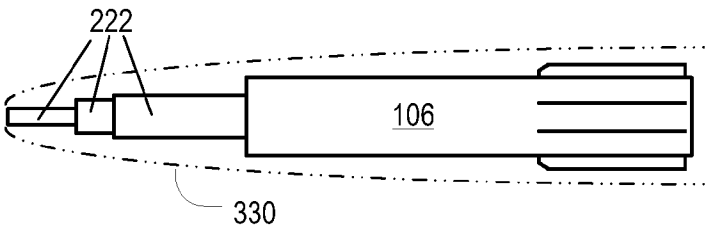
FIG. 3 depicts the air cavity in which a supercavitating projectile moves, as in known in the prior art.

FIG. 2 depicts an embodiment of projectile 106. The projectile comprises nose 220 and body 226. Nose 220 is characterized by a plurality of substantially right-circular cylindrical sections 222. Tip 224 of nose 220 is flat, as is required to create the cavitation phenomena. As depicted in FIG. 3, the gradual increase in diameter of cylindrical sections 222 defines a geometry that remains completely within the bounds of vapor cavity 330 that forms due to the supercavitation phenomena. It also prevents the projectile from pitching down (i.e., overturning) during water entry. The aft section of body 226 includes a plurality of fins 228, as shown in FIG. 2.

As previously indicated, the center of gravity of projectile 106 should be situated as far forward as possible to prevent the in-water projectile from overturning. This is addressed, in some embodiments, via two different materials of construction. In particular, a relatively more dense material is used for the nose, etc., and a relatively less dense material is used for the body. For example, in some embodiments, the nose comprises tungsten and the body comprises bronze. In some other embodiments, the nose is tungsten and the body comprises aluminum. In yet some further embodiments, the nose comprises tungsten and the body comprises titanium. In some additional embodiments, the nose and body comprise S-7 steel. In some embodiments, the projectile comprises a back that is at least partially "hollowed out." The removal of material from the aft section of the projectile serves to keep its center of gravity forward.

It has been shown through experimentation that projectiles having lengths within the range of approximately 4 inches to approximately 9 inches and diameters within the range of approximately 0.5 inch to approximately 2 inches have beneficial performance characteristics. It should be noted, however, that these dimensions are merely representative and are not intended to limit the present invention.

Figure 4:
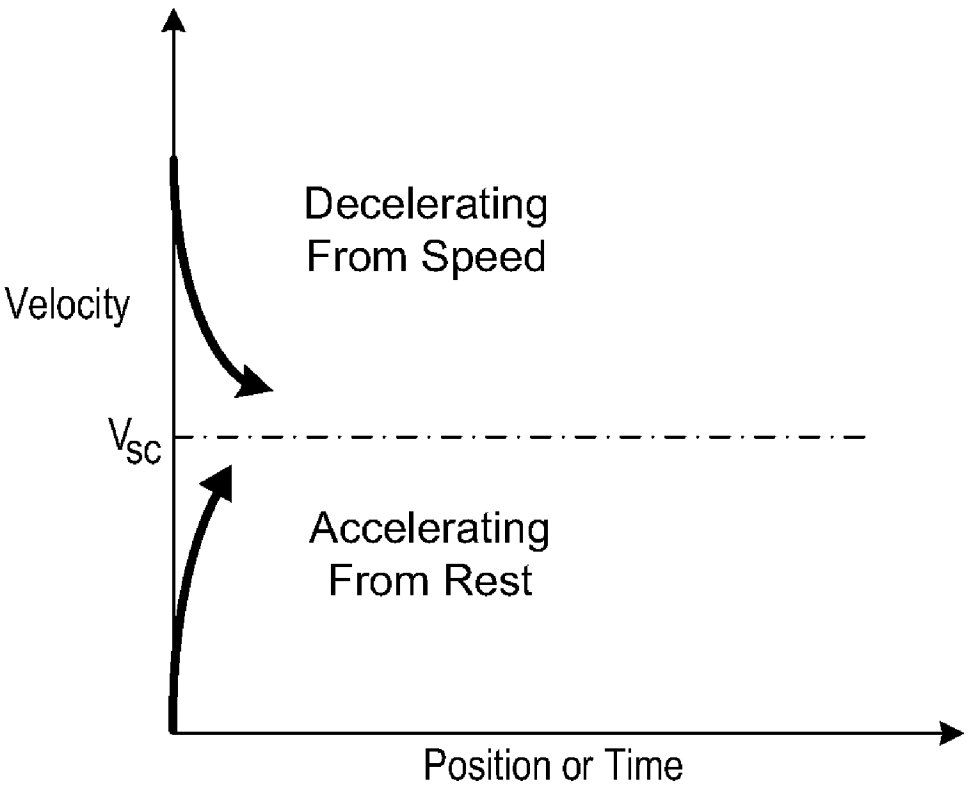
FIG. 4 depicts two basic operational modes for a supercavitating projectile.

There are two basic modes of operation for a cavity-running projectile. One is to launch a projectile at a speed that is well in excess of velocity $V_{sc}$ required to sustain supercavitation. The aforementioned system in which projectile 106 is launched from the deck of a ship through air and then into the water is an example of this mode of operation. This mode is illustrated in the upper portion of the plot depicted in FIG. 4 (entitled "Decelerating From Speed"). The plot depicts a decrease in the velocity of the projectile toward velocity $V_{sc}$.

A second mode of operation is to launch a powered projectile underwater. In this mode, the velocity of the projectile increases to velocity $V_{sc}$. This mode is illustrated in the lower portion of the plot depicted in FIG. 4 (entitled "Accelerating From Rest").

Regardless of operating mode, it is advantageous to reduce the amount of thrust that is required to sustain a projectile in a cavity-running mode of operation through water. In fact, the present inventor found that there is a relationship between the threshold thrust and the ratio of the diameter $D_B$ of the body of the projectile to the diameter $D_N$ of the nose of the projectile. That is, to the extent that certain other parameters are fixed, there an "optimal" ratio of the aforementioned diameters, in the sense that it minimizes the threshold thrust. That optimal value of the ratio is:

$$D_B:D_N \sim 4.1 \quad [3]$$

From the same derivation, minimal supercavitating velocity $V_{sc}$* is given by:

$$V_{sc}^*=4.265V_c \quad [4]$$

wherein:

$V_c$ is the characteristic velocity: $V_c=(2P/\rho_{water})$; and

P is the static drag.

From the same derivation, the minimal amount of thrust F* to maintain supercavitating operation is given by:

$$F^*=(\pi/4)12D_N^2C_{d0}P(1+(\delta_1/\delta_0)^2]) \quad [5]$$

wherein:

$D_N$ is the diameter of the projectile's nose;

$C_{d0}$ is the drag coefficient under supercavitation (~0.2);

P is the static drag on the projectile;

$\delta_0$=0.213387 (empirically determined); and $\delta_1$=0.910052 (empirically determined).

Expression [5] is approximately equal to:

$$F^* \sim 12D_N^2P \quad [6]$$

The present inventor also developed an expression for determining the maximum allowable depth H* in water for the projectile, while sustaining a cavity-running mode, based on the available thrust. The depth H* is given by:

$$H^*=((F_{max}/[(\pi/4)12D_N^2C_{d0}(1+(\delta_1/\delta_0)^2])-ATM)/(\rho_{water}g) \quad [7]$$

wherein:

$F_{max}$ is maximum available thrust;

$D_N$ is the diameter of the projectile's nose;

$C_{d0}$ is the drag coefficient under supercavitation (~0.2);

$\delta_0$=0.213387 (empirically determined);

$\delta_1$=0.910052 (empirically determined);

ATM is the water pressure bearing on the projectile;

$\rho_{water}$ is the density of the water at the relevant temperature; and g is the acceleration due to gravity.

Expression [7] is approximately equal to:

$$H^* \sim (F_{max}/(12D_N^2)-ATM)/(\rho_{water}g). \quad [8]$$

The present inventor also developed an expression for determining an "optimal" diameter $D_N$* of the projectile's nose given available thrust F and operating depth H. Optimal in a sense that, at the calculated nose diameter, the thrust is the threshold thrust.

$$D_N^*=((F_{max}/(\rho_{water}gH+ATM))/[(\pi/4)D_N^2C_{d0}(1+(\delta_1/\delta_0)^2])^{0.5} \quad [9]$$

wherein:

$F_{max}$ is maximum available thrust;

$D_N$ is the diameter of the projectile's nose;

$C_{d0}$ is the drag coefficient under supercavitation (~0.8);

$\delta_0$=0.213387 (empirically determined);

$\delta_1$=0.910052 (empirically determined);

ATM is the water pressure bearing on the projectile;

$\rho_{water}$ is the density of the water at the relevant temperature; and g is the acceleration due to gravity.

Expression (9) is approximately equal to:

$$H^*=1/(12)^{0.5}(F_{max}/(\rho_{water}gH+ATM))^{0.5} \quad [10]$$

As discussed later in this specification, expressions [3], [4], [5]/[6], [7]/[8], and [9]/[10] can be used as the basis for various operating scenarios for the projectile.

For either of the two basic operating modalities disclosed above, an issue arises as to the most efficient way to implement method to achieve a specific goal. One example is what approach should be taken to minimize the time-to-target for a cavity-running projectile that is launched at high speed. A second example is what approach should be taken to minimize the amount of thrust required to travel a certain distance in a cavity-running mode.

Figure 5:
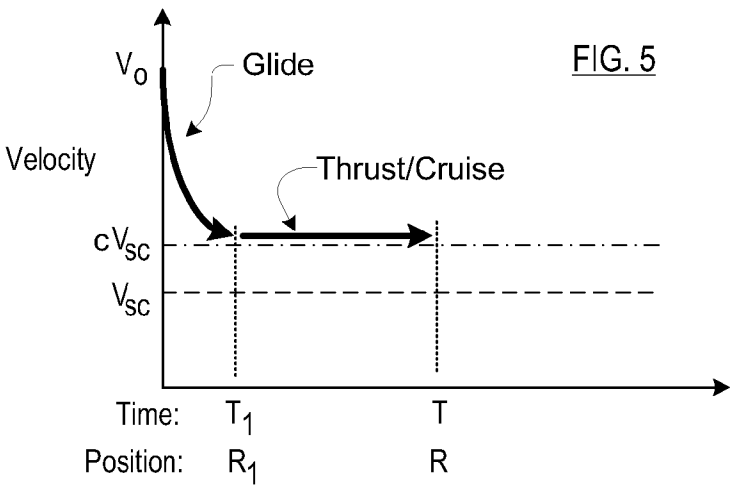
FIG. 5 depicts, graphically, a method for operating a supercavitating projectile in accordance with the illustrative embodiment of the present invention.
Figure 6:
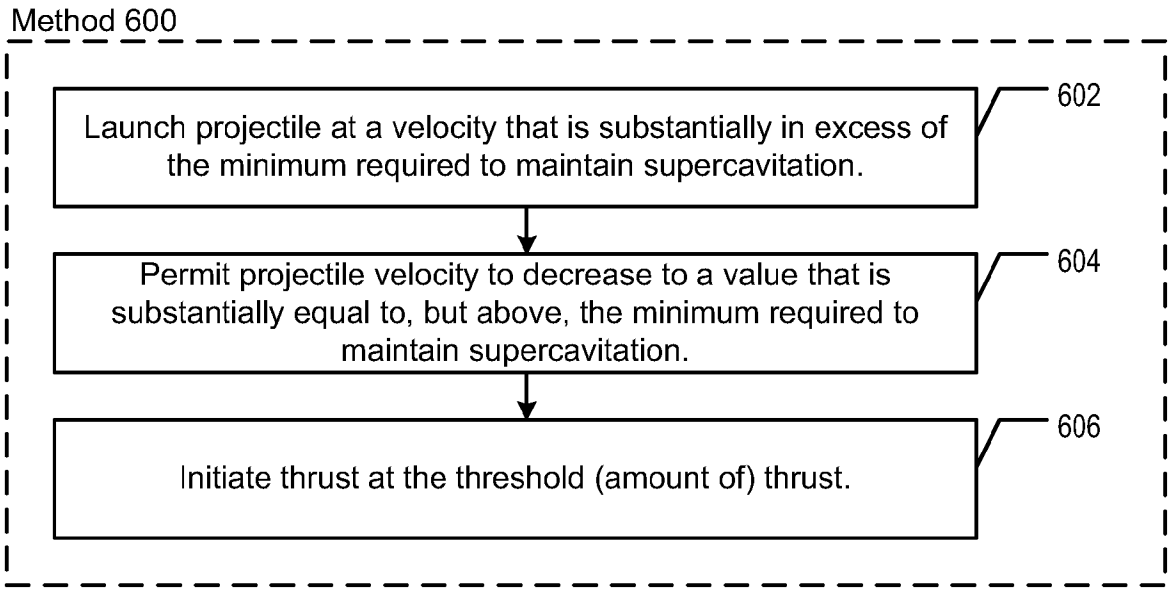
FIG. 6 depicts a flow diagram of the method depicted in FIG. 5.

FIGS. 5 and 6 depict a method for reducing arrival time at R of a supercavitation projectile by delaying thrust.

The present inventor recognized that when projectile 106 is launched, for example, from a deck-mounted launcher, it's velocity will be well in excess of the 100 mph or so that is required for sustaining supercavitation. As the projectile initially enters the water, it experiences high drag forces. These high drag forces persist until a vapor cavity fully develops around the projectile. Within the cavity, drag forces are much lower, but a relatively higher velocity results in a relatively higher drag on the projectile. As velocity rapidly decreases, drag forces decline, unless and until supercavitation is lost.

Given a powered projectile, the inventor recognized that in view of the foregoing considerations, the minimum time to target might not result from operating the projectile at maximum thrust. It turns out, in fact, that the best strategy for reducing time-to-target (or time of arrival) for a supercavitating projectile is actually to delay thrust. In particular, given a powered projectile that is launched at a speed well in excess of that required for supercavitation, the best strategy is launch, delay thrusting until the projectile is about to lose supercavitation, and then apply thrust slightly about the threshold amount that is required to maintain supercavitation.

As depicted in FIGS. 5 and 6, the projectile is launched at an initial velocity $V_0$ that is well in excess of that required for supercavitation (operation 602), and the projectile is allowed to "glide" until the projectile's velocity drops to value $cV_{sc}$ that is close to the minimum velocity $V_{sc}$ required to maintain supercavitation (operation 604). That occurs at time $t_1$ after traveling distance $R_1$. At that time, thrust is applied to maintain near-minimum supercavitation velocity $cV_{sc}$ (operation 606) for the distance $R-R_1$.

The inventor analytically derived formulae for the velocity and distance traveled by a cavity-running projectile with and without propulsion. Travel from time 0 to time $t_1$ is without thrust; $t_1$ is the time delay. The time $t_2=(T-t_1)$ for traveling the remaining distance $R-R_1$ is derived. The projectile is propelled against drag due that is experienced in the cavity at velocity $cV_{sc}$ for the time period $t_2$. The final expressions are obtained via calculus by obtaining and equating the first derivative of $t_1+t_2$ with respect to time $t_1$.

The times $t_1$ (previously supplied as expression [1]) and $t_2$ are given by:

$$t_1=[1/(KV_c)]\times[\tan^{-1}(V_0/V_c)-\tan^{-1}(cV_{sc}/V_c)] \quad [1]$$

$$t_2=[R-(\tfrac{1}{2}K)\times\ln[(V^2_0/V^2_c)/(C^2V^2_{sc}+V^2_c)]/(cV_{sc}) \quad [11]$$

wherein:

$K=(\Pi/8m)\times\rho_{water}D_N^2C_{d0}$;

m is the mass of the projectile;

$\rho_{water}$ is the density of the water at the relevant temperature;

$D_N$ is the diameter of the projectile's nose;

$C_{d0}$ is the drag coefficient under supercavitation;

c is a parameter used for specifying thrust ($c \geqq 1$ at high thrust [e.g., c=1.1], $c<1$ at low thrust);

$V_c$ is the characteristic velocity: $V_c=(2P/\rho_{water})$; and

P is the static drag.

Total time to impact (or arrival) T is $t_1+t_2$ [12]

And the distance traveled at $t_1$ is given by:

$$R_1=(\tfrac{1}{2}K)\times \ln[(V^2_0/V^2_C)/(V^2_1+V^2_c)] \quad [13]$$

$$\text{Wherein } V_1=cV_{sc}=V_c\times\tan[\tan^{-1}(V_0/V_c)-KV_ct_1] \quad [14]$$

Figure 7:
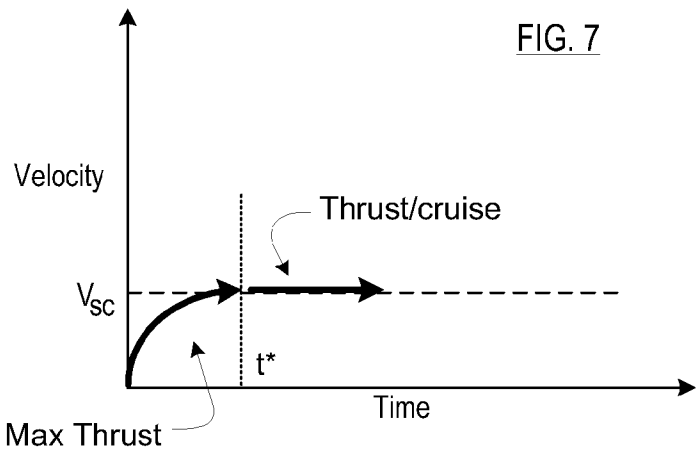
FIG. 7 depicts, graphically, a method for operating a supercavitating projectile in accordance with an alternative embodiment of the present invention.
Figure 8:
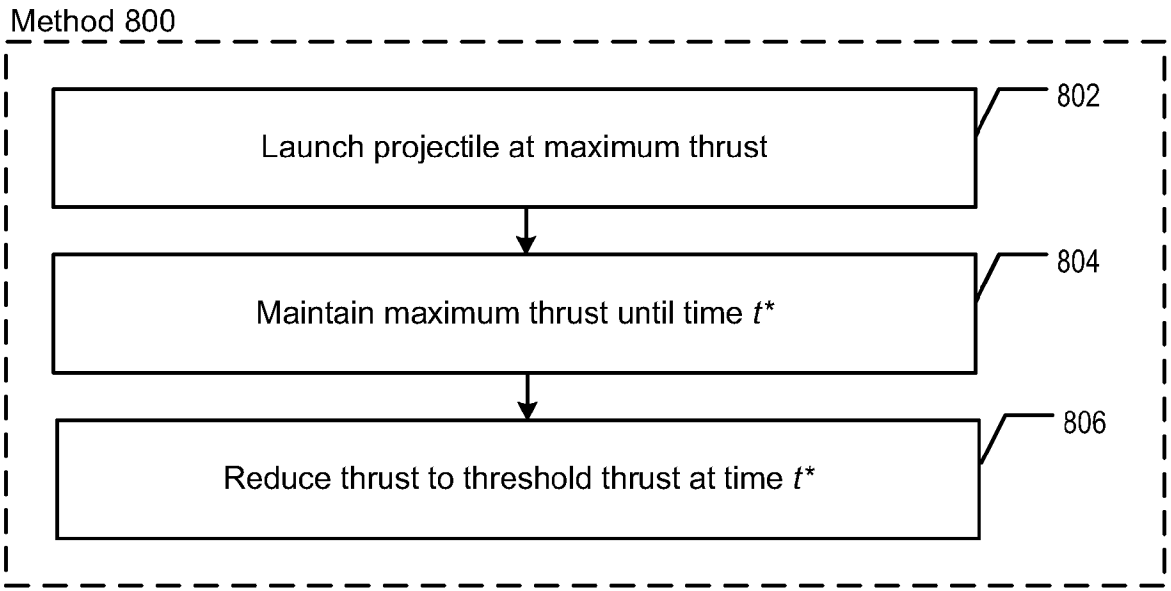
FIG. 8 depicts a flow diagram of the method depicted in FIG. 7.

FIGS. 7 and 8 depict an efficient method for accelerating from rest (zero velocity) to supercavitation.

As depicted in FIGS. 7 and 8, the projectile is accelerated from rest at the maximum available thrust $B_{max}$ (operation 802). The projectile is accelerated to supercavitation at velocity $V_{sc}$, which occurs at time t* (operation 804). Once in a cavity-running mode, thrust is reduced to the threshold thrust $B_{ss}$, which is the minimum amount of thrust that is required to maintain supercavitation (operation 806).

The inventor analogized the problem to a "charge-up" application of the switching techniques disclosed in U.S. Pat. No. 6,611,119 and co-pending patent application Ser. No. 12/119,991.

The time to switch from maximum thrust to threshold thrust (previously presented as expression [2] is given by the expression:

$$t^*=(\tfrac{1}{2}K_b)\times \ln[(1+(2-\epsilon)^{0.5})/(1-\epsilon^{0.5})], \quad [2]$$

wherein:

$K_b=(\Pi/8m)\times\rho_{water}D_B^2C_{d0}$;

m is the mass of the projectile;

$\rho_{water}$ is the density of the water at the relevant temperature;

$D_B$ is the diameter of the projectile's body;

$C_{d0}$ is the drag coefficient under supercavitation;

$\epsilon=E/E_{s,\,max}$ $E=E_c\equiv\tfrac{1}{2}V^2$ $E_{s,\,max}=(B_{max}/2K_b)-E_c$ V is projectile velocity; and $B_{max}$ is the maximum available thrust.

Threshold thrust $B_{ss}$ is given by:

$$B_{ss}=2K_n(E_s+E_c), \quad [15]$$

wherein: $K_n=(\Pi/8m)\times\rho_{water}D_N^2C_{d0}$

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. A method for operating a supercavitating projectile, comprising:

launching a thrust-generating, supercavitating-capable projectile in water from rest at maximum available thrust;

maintaining the maximum available thrust until supercavitation begins at a time t*; and reducing thrust to a threshold thrust at time t*, which is substantially no more thrust than is required to maintain supercavitating movement of the projectile.

2. The method of claim 1 wherein time t* is given by the expression:

$$t^*=(\tfrac{1}{2}K_b)\times \ln[(1-\epsilon)^{0.5})/(1-\epsilon^{0.5})],$$

wherein:

$K_b=(\Pi/8M)\times\rho_{water}D_B^2C_{d0}$;

m is the mass of the projectile;

$\rho_{water}$ is the density of the water at the relevant temperature;

$D_B$ is the diameter of the projectile's body;

$C_{d0}$ is the drag coefficient under supercavitation;

$\epsilon=E/E_{s,\,max}$ $E=E_c\equiv\tfrac{1}{2}V^2$ $E_{s,\,max}=(B_{max}/2K_b)-E_c$ V is projectile velocity; and $B_{max}$ is the maximum available thrust.

3. The method of claim 2 wherein the projectile has a nose and a body, and wherein the ratio of the diameter of the body, $D_B$, to a diameter of the nose, $D_N$, is about 4.1.

4. The method of claim 1 wherein the threshold thrust is given by the expression:

$$B_{ss}=2K_n(E_s+E_c),$$

wherein:

$K_n=(\Pi/8m)\times\rho_{water}D_N^2C_{d0}$;

m is the mass of the projectile;

$\rho_{water}$ is the density of the water at the relevant temperature;

$D_B$ is the diameter of the projectile's body;

$C_{d0}$ is the drag coefficient under supercavitation;

$\epsilon=E/E_{s,\,max}$ $E=E_c=\tfrac{1}{2}V^2$ $E_{s,\,max}=(B_{max}/2K_b)-E_c$ V is projectile velocity; and $B_{max}$ is the maximum available thrust.

* * * * *